US009558717B2

(12) United States Patent
Takasugi et al.

(10) Patent No.: US 9,558,717 B2
(45) Date of Patent: Jan. 31, 2017

(54) DISPLAY APPARATUS

(71) Applicant: LG Display Co., Ltd., Seoul (KR)

(72) Inventors: Shinji Takasugi, Gyeonggi-do (KR); Hae Yoon Kang, Gyeonggi-do (KR); Mi Hee Uhm, Chungcheongnam-do (KR)

(73) Assignee: LG Display Co., Ltd., Seoul (KR)

( * ) Notice: Subject to any disclaimer, the term of this patent is extended or adjusted under 35 U.S.C. 154(b) by 26 days.

(21) Appl. No.: 14/748,488

(22) Filed: Jun. 24, 2015

(65) Prior Publication Data

US 2015/0379939 A1 Dec. 31, 2015

(30) Foreign Application Priority Data

Jun. 30, 2014 (KR) ..... 10-2014-0080761

(51) Int. Cl.
*G09G 5/18* (2006.01)
*G09G 3/32* (2016.01)

(52) U.S. Cl.
CPC ..... *G09G 5/18* (2013.01); *G09G 3/3233* (2013.01); *G09G 2300/0452* (2013.01); *G09G 2300/0842* (2013.01); *G09G 2320/0295* (2013.01); *G09G 2320/043* (2013.01); *G09G 2340/0457* (2013.01)

(58) Field of Classification Search
CPC ..... G09G 3/3291; G09G 5/10; G09G 5/02
See application file for complete search history.

(56) References Cited

U.S. PATENT DOCUMENTS

2007/0236433 A1* 10/2007 Koyama ..... G09G 3/3611 345/87
2009/0041348 A1* 2/2009 Someya ..... G09G 3/2007 345/690
2009/0141015 A1* 6/2009 Kasai ..... G09G 3/3291 345/212
2013/0147694 A1 6/2013 Kim et al.
2015/0154913 A1 6/2015 Kim

FOREIGN PATENT DOCUMENTS

KR 10-2013-0066449 A 6/2013
KR 10-2015-0064460 A 6/2015
KR 10-2015-0065026 A 6/2015

* cited by examiner

*Primary Examiner* — Kevin M Nguyen
(74) *Attorney, Agent, or Firm* — Morgan, Lewis & Bockius LLP

(57) ABSTRACT

The present application relates to a display apparatus having a panel including sub-pixels, data lines, and horizontal lines; a sensing circuit to collect sensing data by sensing for external compensation in the horizontal lines; a calculator to determine a characteristic change of each of the sub-pixels using the sensing data to calculate an external compensation value; a data aligner to receive input image data, and when the input image data corresponds to a horizontal line where the sensing is performed, to convert the input image data into compensation image data based on a compensation value; and a data driver to output a compensation data voltage corresponding to the compensation image data to a data line corresponding to the sensed horizontal line before and after the sensing is performed, and output a sensing data voltage to the data line while the sensing is performed.

9 Claims, 6 Drawing Sheets

DISPLAY APPARATUS

CROSS-REFERENCE TO RELATED APPLICATIONS

This application claims the benefit of Korean Patent Application No. 10-2014-0080761 filed on Jun. 30, 2014, which is hereby incorporated by reference as if fully set forth herein.

BACKGROUND

Technical Field

Embodiments of the present invention relate to a display apparatus and a driving method thereof, and particularly, to a display apparatus for performing external compensation through a sensing line.

Discussion of the Related Art

A flat panel display (FPD) apparatus may be applied to various electronic devices, such as portable phones, tablet personal computers (PCs), notebook computers, etc. Examples of the FPD apparatus include liquid crystal displays (LCD), plasma display panels (PDPs), organic light emitting diode (OLED) display apparatuses, etc. Recently, electrophoretic displays (EPD) have been more widely used as an FPD apparatus.

Among the displays, organic light emitting displays use a self-emitting device and thus may typically have a fast response time, high emission efficiency, high luminance, and a wide viewing angle.

That is, OLED displays are self-emitting apparatuses that recombine an electron with a hole to emit light from an OLED, thereby displaying an image. OLED displays typically have a fast response time and lower power consumption. Furthermore, because they include a self-emitting device, they typically have a good viewing angle. Therefore, OLED display apparatuses are attracting much attention as a next generation FPD apparatus.

However, in a related art OLED display apparatus, a characteristic deviation of a threshold voltage (Vth) and a mobility of a driving transistor occurs in each pixel due to a process differential, deterioration, and/or the like. Therefore, the amounts of currents for driving a plurality of OLEDs differ, and for this reason, a luminance deviation occurs between pixels.

In order to solve such a problem, an external compensation method that corrects input image data to compensate for a characteristic change of a driving transistor included in each pixel is disclosed in Korean Patent Publication No. 10-2013-0066449 (or U.S. 2013/0147694).

FIG. 1 is an example diagram of a related art OLED display apparatus showing a horizontal line where sensing for external compensation is performed. In FIG. 1, point A refers to one sub-pixel provided on a horizontal line where sensing for external compensation is not performed, and point B refers to one sub-pixel provided on a horizontal line where sensing for external compensation is performed. Also, plot (a) of FIG. 1 shows luminance at point A, and plot (b) of FIG. 1 shows luminance at point B.

In OLED display apparatuses, sensing for external compensation is generally performed in units of one horizontal line, for example, during a vertical blank time provided between frames.

In this case, in a horizontal line where sensing for external compensation is performed, an image is not displayed during the vertical blank time. Therefore, as shown by example in FIG. 1, the horizontal line where the sensing for external compensation is performed is illustrated as a dark line. For example, an image is not displayed on a plurality of sub-pixels provided on the horizontal line where the sensing for external compensation is performed, and thus, the horizontal line has low luminance in comparison with other horizontal lines.

As shown in plot (b) of FIG. 1, a non-emission period (e.g., no emission) when light is not emitted from an OLED occurs in a sub-pixel where sensing for external compensation is performed. In this case, as shown in plot (b) of FIG. 1, the non-emission period when light is not emitted from the OLED includes a period when sensing is performed, and moreover includes a period (a curve period) when an anode is charged with a voltage for emitting light from the OLED after the sensing period.

However, as shown in plot (a) of FIG. 1, a sub-pixel where sensing for external compensation is not performed continuously emits light. Therefore, a luminance of a horizontal line where sensing for external compensation is performed is lower than that of a horizontal line where sensing for external compensation is not performed. The resulting horizontal line where sensing for external compensation is performed may be seen by a user's eyes.

This visible phenomenon, where a horizontal line is seen by a user, may severely occur in a pixel that emits light at a low gray scale. For example, because a pixel that emits light at a low gray scale has a low level of current, an anode charging period of the pixel is extended. Therefore, a non-emission area is enlarged, and for this reason, the visible phenomenon where a horizontal line is seen by a user is intensified. Moreover, an upper end and a lower end of a panel can have a difference in the degree of the visible phenomenon where a horizontal line is seen by a user.

The above-described phenomenon may generally occur in OLED display apparatuses. However, it can also occur in other various kinds of display apparatuses where external compensation is performed.

SUMMARY

Accordingly, the present invention is directed to a display apparatus and a driving method thereof that may substantially obviate one or more problems due to limitations and disadvantages of the related art.

An object of the present invention is to provide a display apparatus configured such that when the apparatus receives input image data corresponding to a horizontal line where sensing for external compensation is performed, the input image data is converted into compensation image data by using a compensation value, and a compensation data voltage corresponding to the compensation image data is output to a data line before and after the sensing for external compensation is performed.

Additional advantages and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these and other advantages and in accordance with the purpose embodiments of the invention, as embodied and broadly described herein, a display apparatus includes: a panel including a plurality of sub-pixels, a plurality of data lines, and a plurality of horizontal lines; a sensing circuit configured to collect sensing data by sensing for external compensation in each of the horizontal lines; a calculator configured to determine a characteristic change of each of the sub-pixels using the sensing data to calculate an external compensation value; a data aligner configured to receive input image data, and when the input image data corresponds to a horizontal line where the sensing is performed, to convert the input image data into compensation image data based on a compensation value; and a data driver configured to output a compensation data voltage corresponding to the compensation image data to a data line corresponding to the sensed horizontal line before and after the sensing is performed, and output a sensing data voltage to the data line while the sensing is performed.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiments of the invention and together with the description serve to explain the principles of embodiments of the invention. In the drawings.

DETAILED DESCRIPTION OF THE INVENTION

Figure 1:
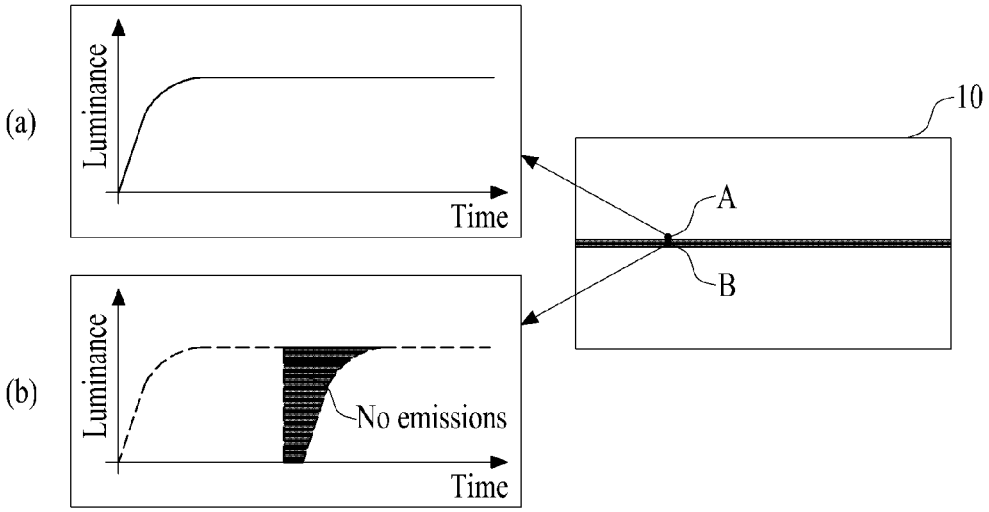
FIG. 1 (RELATED ART)
FIG. 1 is an example diagram showing a horizontal line where sensing for external compensation is performed in a related art OLED display apparatus.
Figure 2:
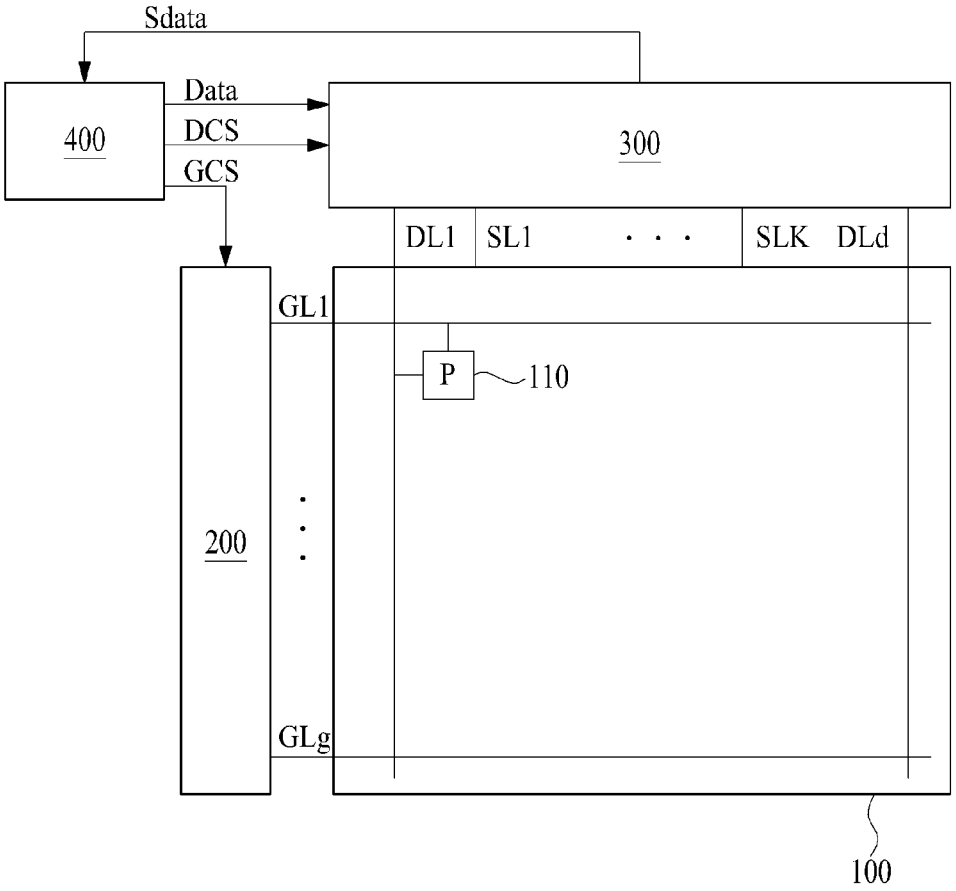
FIG. 2 is an example diagram schematically illustrating a configuration of an OLED display apparatus according to an embodiment of the present invention.

Reference will now be made in detail to embodiments of the present invention, examples of which are illustrated in the accompanying drawings. Where possible, the same or similar reference numbers may be used throughout the drawings to refer to the same or like parts.

Hereinafter, example embodiments of the present invention will be described in detail with reference to the accompanying drawings. The present invention may be applied to various kinds of display apparatuses where external compensation is performed. In this disclosure, for convenience of description, an OLED display apparatus will be described as an example embodiment of the present invention, but the display apparatuses are not limited thereto.

Embodiments of the present invention may decrease the phenomenon discussed above, e.g., a phenomenon where a line where sensing is performed is seen by a user's eyes when external compensation is performed in real time.

Generally, when sensing for real-time external compensation is performed by using a blank time, a data voltage having the same level as that of the original data voltage is output through a data line during a frame period which remains after a threshold voltage (Vth) or a mobility of each pixel is sensed, in order to realize the original luminance. However, because a pixel cannot emit light during a period where sensing for external compensation is performed, a horizontal line where sensing is performed appears dark to a user's eyes.

Embodiments of the present invention may prevent a line where sensing is not performed from being seen by a user's eyes due to a reduction in a luminance of a horizontal line where sensing is performed. To this end, embodiments of the present invention may supply a compensation data voltage, which is generated by adding an additional data voltage to the original data voltage, to a data line during (a) a normal writing period before sensing is performed and (b) a recovery writing period after the sensing is performed, thereby preventing a luminance of a line where sensing is performed from being reduced. Therefore, a phenomenon where a horizontal line where sensing is performed is seen by a user's eyes is reduced. The additional data voltage may correspond to a compensation value to be described below.

The OLED display apparatus according to an embodiment of the present invention, as illustrated in FIGS. 2 to 6, may include: a panel 100 where a plurality of sub-pixels P each including an organic light emitting diode (OLED) are provided and where sensing for external compensation is performed for each of a plurality of horizontal lines; a sensing unit 320 that performs sensing for external compensation for each horizontal line of the panel 100 to collect pieces of sensing data; a calculator 410 that determines a characteristic change of each of the plurality of sub-pixels by using the pieces of sensing data to calculate an external compensation value; a data aligner 430 that, when input image data corresponding to a horizontal line where sensing is performed is received, converts the input image data into compensation image data by using the external compensation value; and a data driver 300 that outputs a compensation data voltage corresponding to the compensation image data to a data line provided in the panel 100 before and after the sensing is performed and, when the sensing is performed, outputs a sensing data voltage to the data line. Here, a generic name for the sensing unit 320, the calculator 410, the data aligner 430, the data driver 300, and a gate driver 200 may be a panel driver.

Figure 6:
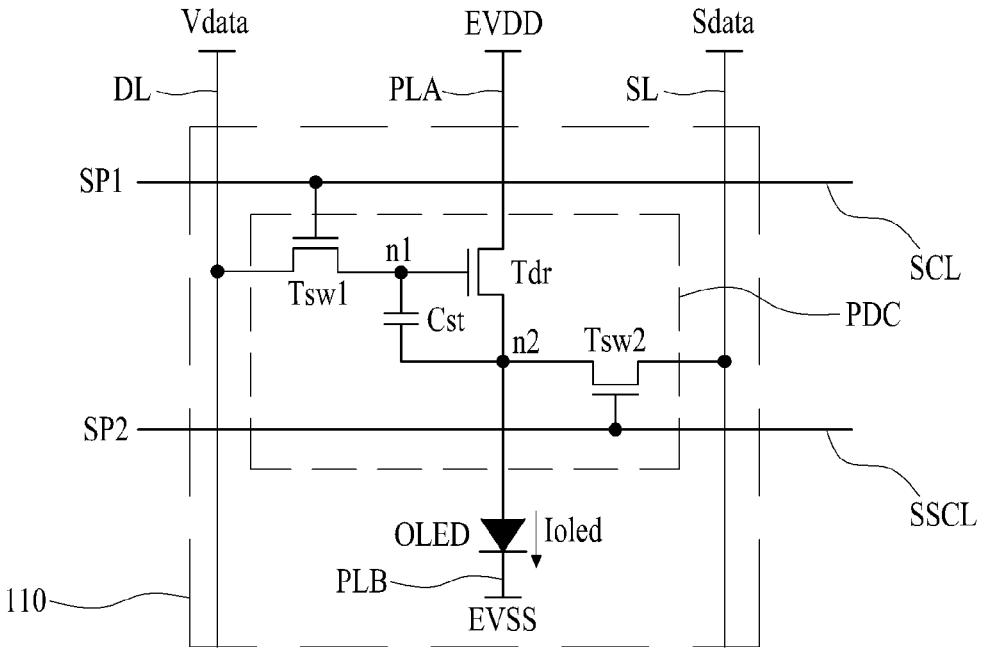
FIG. 6 is an example diagram illustrating a structure of pixels provided in a panel applied to the OLED display apparatus according to an embodiment of the present invention.

As illustrated in FIG. 6, the panel 100 may include a plurality of sub-pixels which each include an organic light emitting diode OLED and a pixel driving circuit PDC. The pixel driving circuit PDC may include a driving transistor Tdr that controls a current flowing in the organic light emitting diode OLED, and a plurality of signal lines that define a plurality of pixel areas where the plurality of sub-pixels 110 are respectively provided, and that supply a driving signal to the pixel driving circuit PDC.

The signal lines may include a scan control line SCL, a sensing control line SSCL, a data line DL, a sensing line SL, a first driving power line PLA, and a second driving power line PLB.

A plurality of the scan control lines SCL may be arranged in parallel at certain intervals along a second direction (e.g., a horizontal direction) of the panel 100. The plurality of sensing control lines SSCL may be arranged at certain intervals in parallel with the scan control lines SCL. Also, the scan control line and the sensing control line may be provided as one line.

A plurality of data lines DL may be arranged in parallel at intervals along a first direction (e.g., a vertical direction) of the panel 100 to intersect the scan control line SCL and the sensing control line SSCL. A plurality of the sensing lines SL may be arranged at intervals in parallel with the data lines DL.

Figure 5:
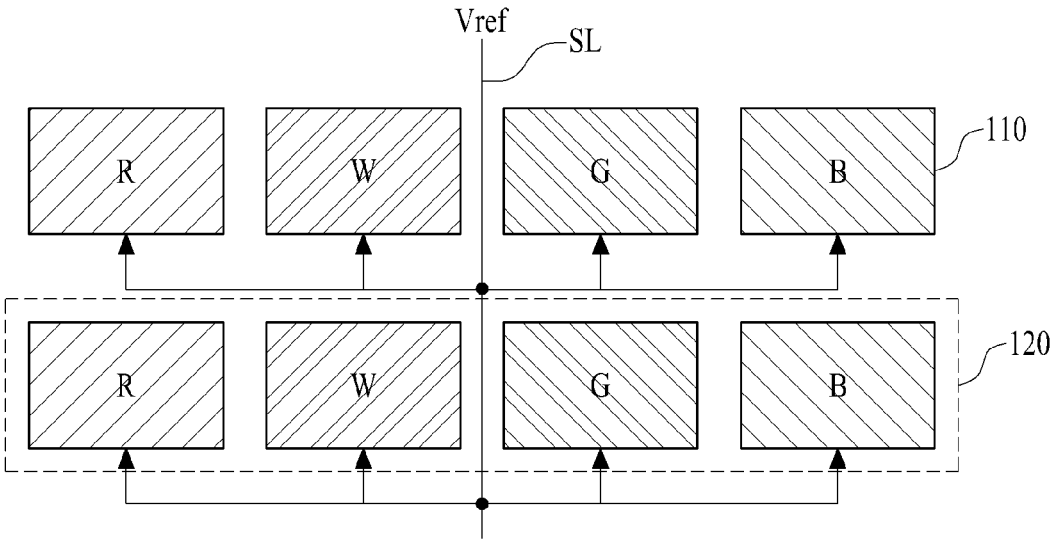
FIG. 5 is an example diagram illustrating a structure of pixels provided in a panel applied to the OLED display apparatus according to an embodiment of the present invention.

At least three sub-pixels 100 may configure one unit pixel 120. In the following description, a case where four sub-pixels 110 (for example, a red sub-pixel R, a white sub-pixel W, a green sub-pixel G, and a blue sub-pixel B) configure one unit pixel 120, as illustrated in FIG. 5, will be described merely as an example embodiment of the present invention. In this case, one sensing line may be provided in the unit pixel 120. Therefore, when 'd' number of data lines DL1 to DL4 are provided on a horizontal line of the panel 100, the number of the sensing lines SL may be d/4.

The data lines DL may be provided in the first direction (the vertical direction) of the panel 100, and the sensing lines SL may be arranged in parallel with the data lines DL. Each of the sensing lines SL, as illustrated in FIG. 5, may be connected to at least three sub-pixels 110 configuring each of a plurality of unit pixels 120 that are provided on one horizontal line.

A plurality of the first driving power lines PLA may be arranged at intervals in parallel with the data line DL. As shown in the drawings, the plurality of the first driving power lines PLA may also be arranged at intervals in parallel with the sensing line SL. The first driving power line PLA may be connected to a driving power supply unit (not shown) and may supply a first driving voltage EVDD, supplied from the driving power supply unit (not shown), to each of the plurality of pixels P.

A plurality of the second driving power lines PLB may be provided all over the panel 100 in a one-piece form, or may be arranged at intervals in parallel with the data lines DL1 to DLd or the scan control lines SL1 to SLk. The second driving power line PLB may supply a second driving voltage EVSS, supplied from the driving power supply unit, to each of the plurality of pixels P. In one embodiment, the second driving power line PLB may be electrically grounded to a case (or a cover which is formed of a metal material and configures the OLED display apparatus). In such an embodiment, the second driving power line may supply a ground voltage (a ground) to each of the plurality of pixels P.

The plurality of pixels P may be respectively provided in a plurality of pixel areas defined by the plurality of scan control lines SCL and the plurality of data lines DL1 to DLd which intersect each other. As shown in the drawings, each of the plurality of pixels P may be one of a red pixel, a green pixel, a blue pixel, and a white pixel.

The one unit pixel 120, as illustrated in FIG. 5, may include a red sub-pixel, a white sub-pixel, a green sub-pixel, and a blue sub-pixel, which are adjacent to each other, or may include a red sub-pixel, a green sub-pixel, and a blue sub-pixel, which are adjacent to each other. In FIG. 5, two unit pixels 120 are shown, where each unit pixel 120 is configured with a red sub-pixel R, a white sub-pixel W, a green sub-pixel G, and a blue sub-pixel B.

Each of the plurality of sub-pixels P, as illustrated in FIG. 6, may include the pixel driving circuit PDC and the organic light emitting diode OLED. The pixel driving circuit PDC may include a first switching transistor Tsw1, a second switching transistor Tsw2, a driving transistor Tdr, and a capacitor Cst. Here, each of the transistors Tsw1, Tsw2, and Tdr may be a thin film transistor (TFT), and for example, may be an amorphous silicon (a-Si) TFT, a poly-Si TFT, an oxide TFT, an organic TFT, or the like.

The first switching transistor Tsw1 may be turned on by a first scan pulse SP1 and may output a data voltage Vdata supplied through the data line DL. To this end, the first switching transistor Tsw1 may include a gate electrode connected to the scan control line SCL adjacent thereto, a first electrode connected to the data line DL adjacent thereto, and a second electrode connected to a first node n1 which is a gate electrode of the driving transistor Tdr.

The second switching transistor Tsw2 may be turned on by a second scan pulse SP2 and may output a reference voltage Vref, supplied through the sensing line SL, to a second node n2 which may be a source electrode of the driving transistor Tdr. To this end, the second switching transistor Tsw2 may include a gate electrode connected to the sensing control line SSCL adjacent thereto, a first electrode connected to the sensing line SL adjacent thereto, and a second electrode connected to the second node n2.

The capacitor Cst may include the gate electrode and a first electrode of the driving transistor Tdr, for example, electrodes respectively connected to the first node n1 and the second node n2. A first electrode of the capacitor Cst may be connected to the first node n1, and a second electrode of the capacitor Cst may be connected to the second node n2. The capacitor Cst may be charged with a difference voltage between a voltage supplied to the first node n1 according to the first switching transistor Tsw1 being turned on, and a voltage supplied to the second node n2 according to the second switching transistor Tsw2 being turned on. The driving transistor Tdr may be turned on according to a voltage charged into the capacitor Cst.

The driving transistor Tdr may be turned on by the voltage of the capacitor Cst and may control an amount of current which flows from the first driving power line PLA to the organic light emitting diode OLED. To this end, the driving transistor Tdr may include the gate electrode connected to the first node n1, the first electrode connected to the second node n2, and a second electrode connected to the first driving power line PLA.

The organic light emitting diode OLED may emit light with a data current Ioled supplied from the driving transistor Tdr, where the luminance of the light corresponds to the data current Ioled. To this end, the organic light emitting diode OLED may include a first electrode (for example, an anode electrode) connected to the second node n2 (e.g., the first electrode of the driving transistor Tdr, e.g., an anode electrode), an organic layer (not shown) disposed on the first electrode, and a second electrode (for example, a cathode electrode) connected to the organic layer. The second electrode of the organic light emitting diode OLED may be the second driving power line PLB which is provided on the organic layer, or may be additionally provided on the organic layer to be connected to the second driving power line PLB.

Hereinabove, a structure of the sub-pixel 110 for performing external compensation has been described with reference to FIG. 6. However, the sub-pixel 110 may be provided in various structures other than or in addition to the structure illustrated in FIG. 6.

For example, the external compensation may denote that a change amount of a threshold voltage or a mobility of the driving transistor Tdr included in the sub-pixel 110 is calculated, and a level of a data voltage supplied to a unit pixel is varied based on the change amount. Therefore, the structure of the sub-pixel 110 may be changed to various types so as to calculate the change amount of the threshold voltage or mobility of the driving transistor Tdr.

Moreover, to perform external compensation, a method of calculating the change amount of the threshold voltage or mobility of the driving transistor Tdr by using the sub-pixel 100 may also be variously changed depending on the structure of the sub-pixel 110.

Embodiments of the present invention may prevent a noise line from occurring in the OLED display apparatus performing external compensation. A structure of a sub-pixel for external compensation may use various structures of a sub-pixel proposed for external compensation, and a method of performing external compensation may use various external compensation methods proposed for external compensation. For example, the structure of the sub-pixel for external compensation and the method of performing external compensation may respectively use structures and methods disclosed in a number of patent documents, for example, Korean Patent Publication No. 10-2013-0066449, and may respectively use structures and methods disclosed in Korean Patent Application Nos. 10-2013-0150057 (or U.S. 2015/0154913) and 10-2013-0149213.

The detailed structure of a sub-pixel for performing external compensation and a detailed external compensation method may be tangential to the scope of the present invention. Therefore, an example of a sub-pixel for external compensation has been described briefly with reference to FIG. 6, and an external compensation method will be described briefly below.

The panel driver may operate the panel 100 in a sensing mode or a display mode. The sensing mode may be performed at every period set by a use, or at every blank time when an image is not displayed. In the sensing mode, an external compensation value for correcting a characteristic change of the driving transistor Tdr may be calculated. Also, in the sensing mode, when input image data corresponding to a horizontal line where sensing is performed is received, the input image data may be converted into compensation image data by using the external compensation value, and a compensation data voltage corresponding to the compensation image data may be supplied to the panel 100 through the data line DL.

In the display mode, an image may be displayed by the panel 100. In the display mode, the input image data may be converted into external compensation image data by using the external compensation value, and an external compensation data voltage corresponding to the external compensation image data may be supplied to the panel 100 through the data line DL.

In the sensing mode, the panel driver may sense a characteristic change (for example, a threshold voltage and/or mobility) of the driving transistor Tdr included in each sub-pixel P through each of first to kth sensing lines SL1 to SLk to generate sensing data Sdata.

The panel driver may calculate the external compensation value based on the sensing data Sdata, and correct input image data Ri, Gi, and Bi supplied from an external system (not shown) by using the external compensation value to generate the external compensation image data. The panel driver may convert the external compensation image data DATA into a data voltage and supply the data voltage to a corresponding sub-pixel P.

For example, to separately compensate for characteristic changes of the driving transistors Tdr included in the respective sub-pixels P, the panel driver may respectively sense the characteristic changes of the driving transistors Tdr through the sensing lines SL1 to SLk, compensate for the input image data Ri, Gi, and Bi by using the sensed characteristic changes of the driving transistors Tdr to generate external compensation image data, convert the generated external compensation image data into external compensation data voltages, and supply the external compensation data voltages to the respective sub-pixels P.

The panel driver may include: the sensing unit 320 that performs external compensation for each horizontal line of the panel 100 to collect pieces of sensing data Sdata; the calculator 410 that determines a characteristic change of each of the plurality of sub-pixels by using the pieces of sensing data Sdata to calculate the external compensation value; the data aligner 430 that, when input image data corresponding to a horizontal line where sensing is performed is received, converts the input image data into compensation image data by using the external compensation value; the data driver 300 that outputs the compensation data voltage corresponding to the compensation image data to a data line provided in the panel 100 before and after the sensing is performed and, when the sensing is performed, outputs a sensing data voltage to the data line; and a gate driver 200 that supplies a first scan pulse SP1 and a second scan pulse SP2 to the scan control lines SCL and the sensing control lines SSCL.

The data aligner 430 may be provided in a controller 400 that controls the data driver 300 and the gate driver 200. The calculator 410 may be included in the controller 400, or may be provided independently from the controller 400. The sensing unit 320 may be provided in the data driver 300, or may be provided independently from the data driver 300.

Figure 3:
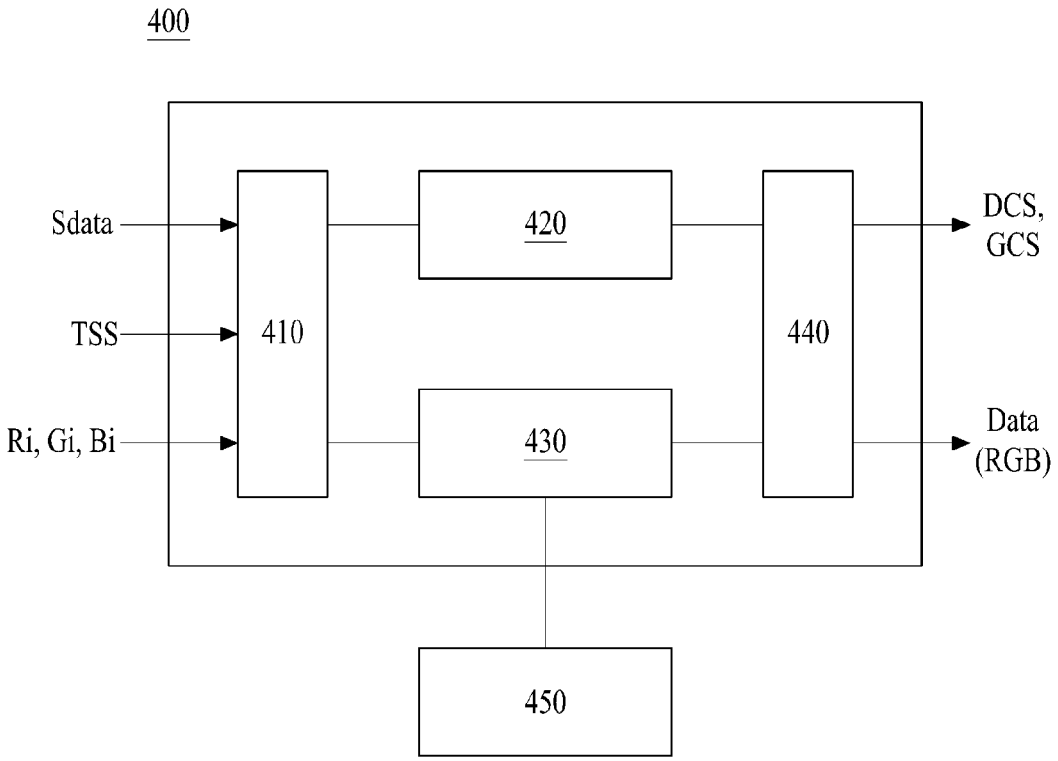
FIG. 3 is an example diagram illustrating a configuration of a controller applied to the OLED display apparatus according to an embodiment of the present invention.
Figure 4:
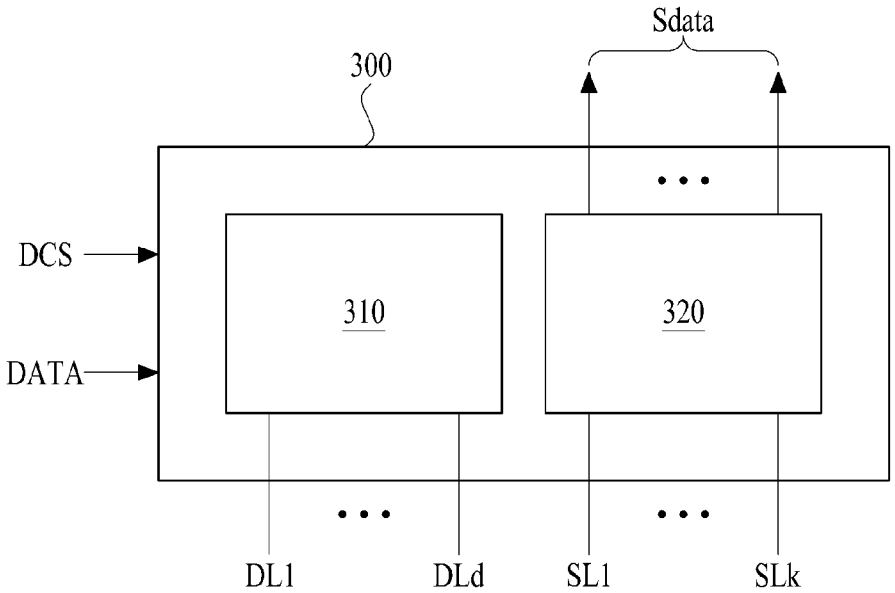
FIG. 4 is an example diagram illustrating a configuration of a data driver applied to the OLED display apparatus according to an embodiment of the present invention.

Hereinafter, an example embodiment where the sensing unit 320 is included in the data driver 300 as illustrated in FIG. 4, and the calculator 410 is included in the controller 400 as illustrated in FIG. 3, will be described as an example of the OLED display apparatus according to an embodiment of the present invention. In this case, as illustrated in FIG. 4, the data driver 300 may include the sensing unit 320 and a data voltage supply unit 310 which supplies various data voltages to the panel 100. The data voltage supply unit 310 may serve as the data driver 300, but when the sensing unit 320 is included in the data driver 300, and for convenience of description, the data driver 300 may be referred to as the data voltage supply unit 310. However, the panel driver applied to the OLED display apparatus according to embodiments of the present invention may be implemented in various structures other than/in addition to a structure described below.

The controller 400 may generate a gate control signal GCS for controlling the gate driver 200 and a data control signal DCS for controlling the data driver 300, based on a timing sync signal TSS supplied from the external system (not shown).

Moreover, in the sensing mode where sensing for external compensation is performed, the controller 400 may transfer sensing image data, which is to be supplied to a plurality of pixels provided on a horizontal line in which external compensation is performed, to the data driver 300. The sensing for external compensation may be performed at various times. Hereinafter, however, a case where external compensation is performed for a blank time between frames will be described as an example embodiment of the present invention. In the sensing mode, the controller 400 may calculate the external compensation value based on sensing data Sdata supplied from the data driver 300, and store the external compensation value in a memory 450. The memory 450 may be included in the controller 400, or may be implemented independently from the controller 400.

In the display mode during which an image is displayed, when input image data is received that corresponds to a horizontal line where sensing for external compensation is performed, the controller 400 may convert the input image data into compensation image data by using an external compensation value. Also, in the display mode, when input image data is received that corresponds to a horizontal line where sensing is not performed, the controller 400 may perform external compensation on the input image data by using the external compensation value to convert the input image data into external compensation image data, or the controller 400 may not perform external compensation, but instead may realign the input image data to convert the input image data into normal image data and output the normal image data, according to a calculator control signal transferred from the calculator 410.

To perform the above-description operations, and with reference to the example shown in FIG. 3, the controller 300 may include: the data aligner 430 that realigns pieces of input image data transferred from the external system (not shown) by using the timing sync signal transferred from the external system (not shown) to supply pieces of output image data to the data driver 300; a control signal generator 420 that generates the gate control signal GCS, the data control signal DCS, and a power control signal PCS, based on the timing sync signal; the calculator 410 that calculates an external compensation value for compensating for a characteristic change of the driving transistor Tdr included in each of the plurality of pixels P by using the pieces of sensing data Sdata transferred from the data driver 300; the memory 450 that stores the external compensation value and a pre-calculated compensation value; and an output unit 440 that outputs various control signals and various pieces of output image data, generated by the data aligner 430, to the data driver 300 or the gate driver 200.

The calculator 410 may determine a characteristic change of each sub-pixel by using the pieces of sensing data Sdata to calculate the external compensation value. For example, in the sensing mode, the calculator 410 may sense a characteristic change of each of a plurality of the organic light emitting diodes OLED by using the pieces of sensing data Sdata, calculate the external compensation value based on the characteristic change, and store the external compensation value in the memory 450. In this case, in the display mode, the data aligner 430 may correct the pieces of input image data by using the external compensation value to generate pieces of external compensation image data, and may transfer the generated pieces of external compensation image data to the data driver 300.

In the display mode, the data aligner 430 may realign the pieces of input image data so as to match a structure of the sub-pixels 110, and may supply pieces of output image data, generated through the realignment, to the data driver 300. For example, the data aligner 430 may correct the pieces of input image data based on the external compensation value and the pre-calculated compensation value.

For example, in the sensing mode during which sensing for external compensation is performed, the data aligner 430 may receive sensing image data, which is to be supplied to each of a plurality of sub-pixels provided on a horizontal line where external compensation is performed, from the memory 450 and transfer the sensing image data to the data driver 300.

In the display mode where an image is displayed, when input image data is received that corresponds to a horizontal line where sensing for external compensation is performed, the data aligner 430 may convert the input image data into compensation image data, based on the compensation value. That is, when the input image data is received that corresponds to the horizontal line where the sensing for external compensation is performed, the data aligner 430 may convert the input image data into the compensation image data by adding the compensation value to the input image data.

Moreover, in the display mode, when input image data is received that corresponds to a horizontal line where the sensing is not performed, the data aligner 430 may perform external compensation on the input image data by using the external compensation value to convert the input image data into external compensation image data, or the data aligner 430 may not perform external compensation but instead may realign the input image data to convert the input image data into normal image data and output the normal image data, according to the calculator control signal transferred from the calculator 410.

That is, in the display mode, input image data is received which corresponds to the horizontal line where the sensing is not performed, and when external compensation for the input image data is needed, the data aligner 430 may convert the input image data into the external compensation image data, based on the external compensation value. On the other hand, when the external compensation for the input image data is not needed, the data aligner 430 may realign the input image data so as to match a structure of the panel 100, thereby converting the input image data into the normal image data.

Therefore, the data aligner 430 may generate the sensing image data in the sensing mode, and in the display mode, the data aligner 430 may generate the compensation image data, the external compensation image data, and the normal image data. The sensing image data, the compensation image data, the external compensation image data, and the normal image data may be generally termed "output image data."

The control signal generator 420 may generate various control signals according to embodiments of the present invention.

As described above, the memory 450 may store the pre-calculated compensation value and the external compensation value transferred from the calculator 410, and may transfer the stored compensation value and external compensation value to the data aligner 430.

In response to the gate control signal GCS supplied from the controller 400, the gate driver 200 may sequentially generate the first scan pulse SP1 and may sequentially supply the first scan pulse SP1 to the scan control lines SCL. In response to the gate control signal GCS, the gate driver 200 may sequentially generate the second scan pulse SP2 and may sequentially supply the second scan pulse SP2 to the sensing control lines SSCL. Here, the gate control signal GCS may include a start signal and a plurality of clock signals.

The gate driver 200 may be directly provided in the panel 100 in a process of forming a TFT of each sub-pixel P. Alternatively, the gate driver 200 may be implemented as a type of integrated circuit (IC) and may be equipped in the panel 100.

The data driver 300 may be connected to the data lines DL1 to DLd and the sensing lines SL1 to SLd, and may operate in the sensing mode or the display mode according to the control signal transferred from the controller 400. If, for example, the data driver 300 includes the data voltage supply unit 310 and the sensing unit 320 as illustrated in FIG. 4, the data voltage supply unit 310 may be connected to the data lines DL, and the sensing unit 320 may be connected to the sensing lines SL.

In the sensing mode, the sensing unit 320 may supply the reference voltage Vref to each of the sensing lines SL1 to SLk, receive a signal corresponding to the reference voltage Vref, and sense a characteristic change of the driving transistor Tdr included in each of a plurality of sub-pixels P provided on one horizontal line according to the received signal to generate sensing data Sdata.

The sensing unit 320 may supply the generated sensing data Sdata to the controller 400. To this end, the sub-pixels P may be configured as illustrated in the example of FIG. 5. For example, one sensing line SL may be provided for each unit pixel 120 including R, G, B, and W sub-pixels 110 among a plurality of sub-pixels provided on one horizontal line. Therefore, when one sensing data voltage is supplied through each sensing line SL, sensing data for one sub-pixel of each unit pixel 120 may be transferred to the sensing unit 320. Each unit pixel 120 may be configured with four sub-pixels, and thus, when four sensing data voltages are supplied through the sensing line SL, pieces of sensing data for all sub-pixels provided on one horizontal line may be generated. The pieces of sensing data for all the sub-pixels provided on the one horizontal line may be transferred to the calculator 410, and the calculator 410 may calculate an external compensation value for each of all the sub-pixels, based on the pieces of sensing data.

In the sensing mode, the data voltage supply unit 310 may convert the output image data DATA (e.g., the sensing image data), transferred from the controller 400, into a sensing data voltage and supply the sensing data voltage to the data line DL. In the display mode, the data voltage supply unit 310 may convert the output image data DATA, which is supplied from the controller 400 in units of one horizontal line, into a data voltage by using a plurality of gamma reference voltages supplied from a reference gamma voltage supply unit (not shown) and supply the data voltage to a corresponding data line DL. In the display mode, the output image data DATA transferred to the data voltage supply unit 310 may be the external compensation image data or the compensation image data.

That is, the data voltage supply unit 310 may sample the output image data DATA of each sub-pixel P, which is input in units of one horizontal line, according to the data control signal DCS and select, as the data voltage, a gamma voltage corresponding to a grayscale value of sampling data among the plurality of reference gamma voltages to supply the selected data voltage to the data line DL of a corresponding sub-pixel P.

In the sensing mode, the sensing unit 320 may sense a voltage of each of the sensing lines SL1 to SLk, generate sensing data Sdata corresponding to the sensed voltage, and supply the sensing data Sdata to the controller 400. To this end, the sensing unit 320 may include an analog-to-digital converter (ADC) that converts a sensing voltage, transferred through a corresponding sensing line, into a digital voltage to generate the sensing data Sdata.

The sensing unit 320 may perform the sensing for a blank time provided between frames and during which data voltages are not output to the data lines DL.

Figure 7:
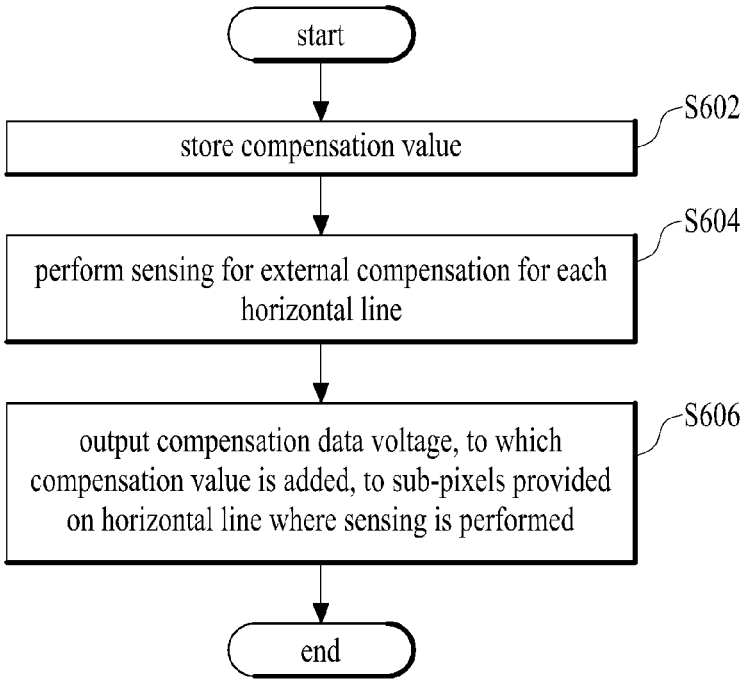
FIG. 7 is a flowchart illustrating a method of driving the OLED display apparatus according to an embodiment of the present invention.
Figure 8:
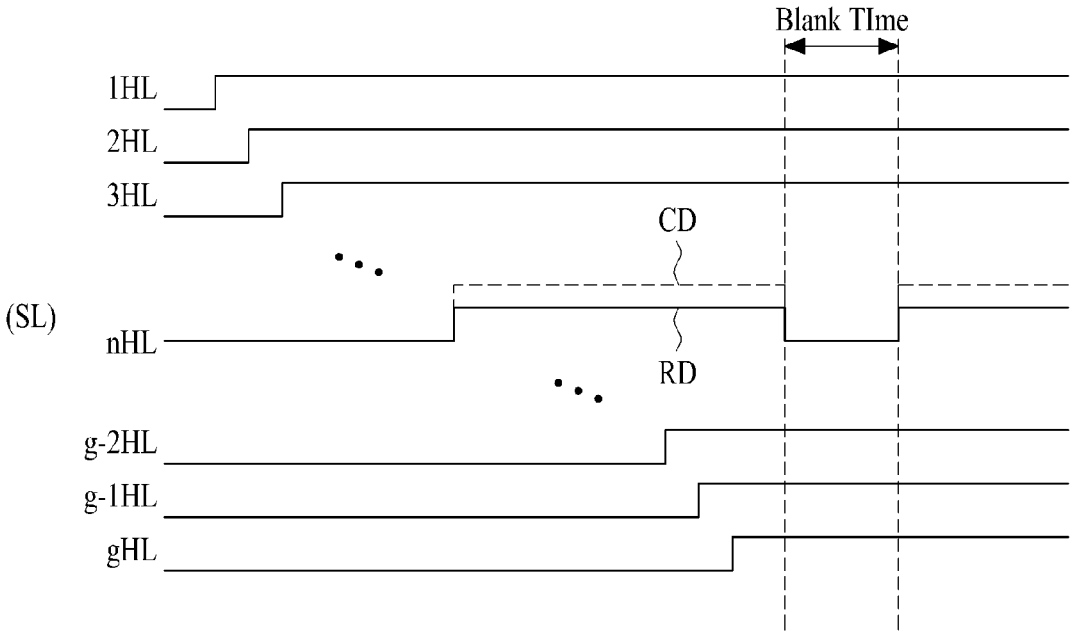
FIG. 8 is an example diagram illustrating a state where a data voltage is output to each horizontal line of the OLED display apparatus according to an embodiment of the present invention.
Figure 9:
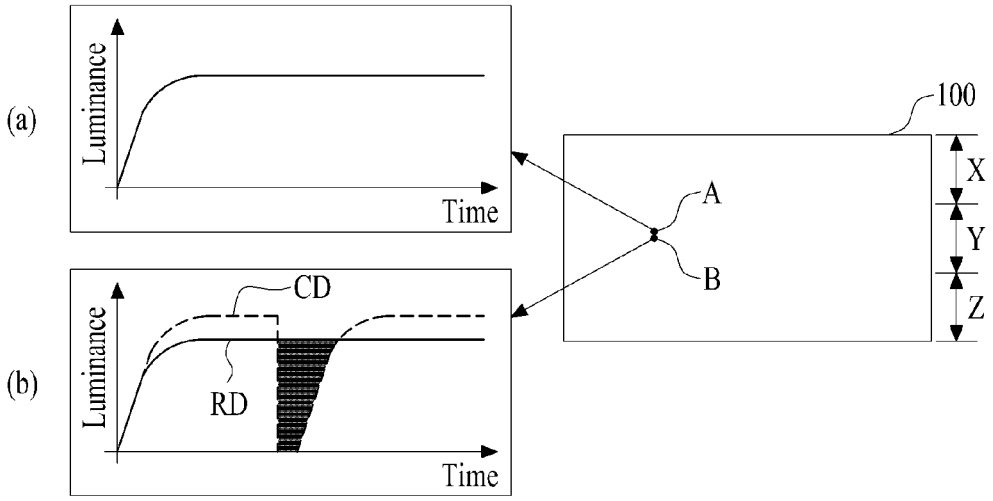
FIG. 9 is a graph showing a luminance of a horizontal line where sensing is performed and a luminance of a horizontal line where sensing is not performed in the OLED display apparatus according to an embodiment of the present invention.
Figure 10:
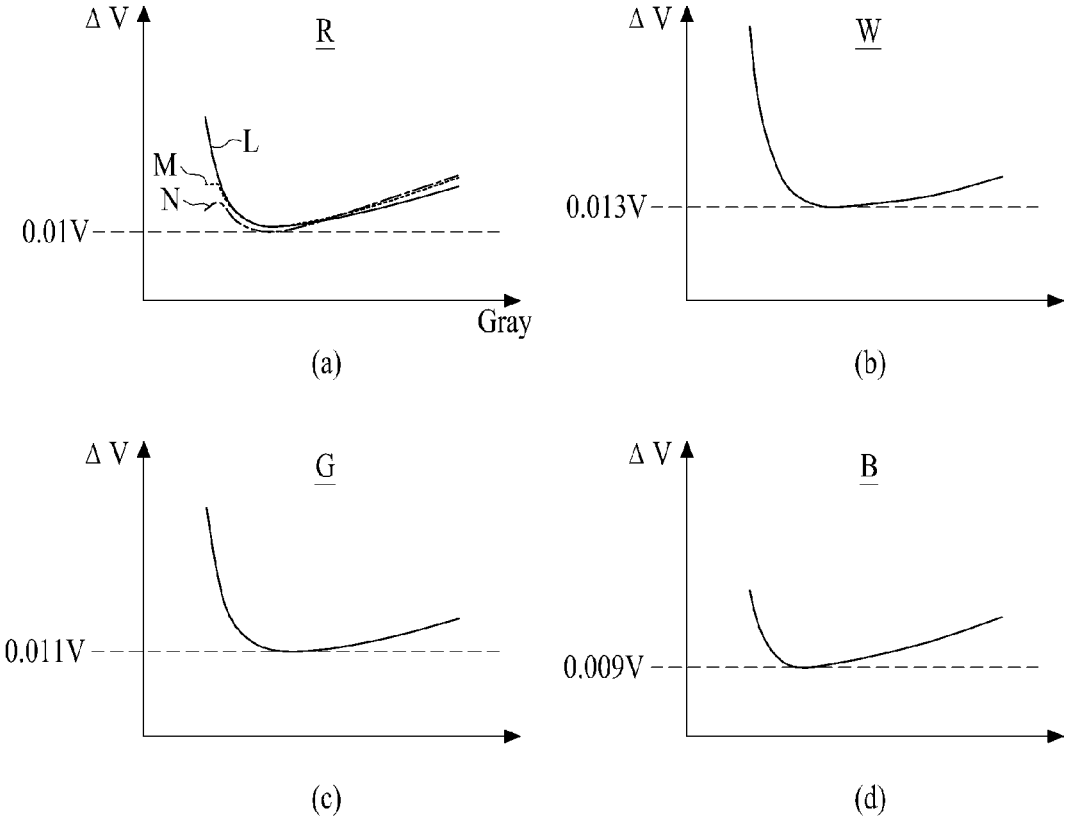
FIG. 10 is a graph for describing a level of a compensation value applied to the OLED display apparatus according to an embodiment of the present invention.
Figure 11:
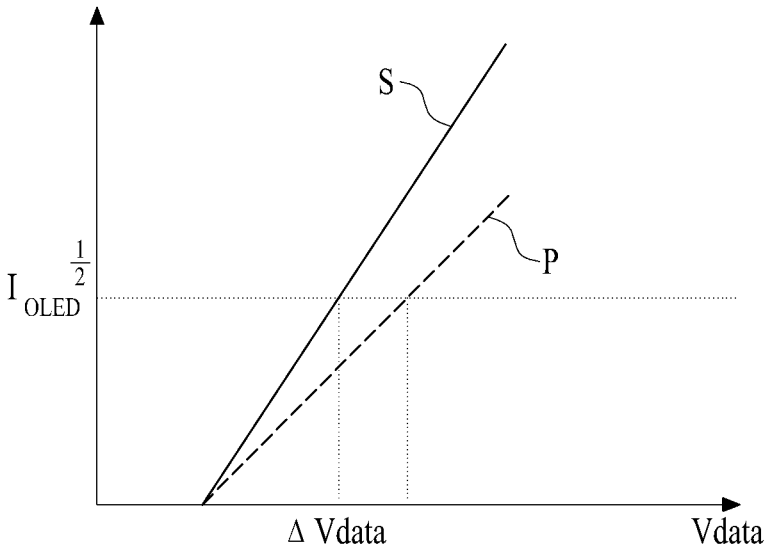
FIG. 11 is another graph for describing a level of a compensation value applied to the OLED display apparatus according to an embodiment of the present invention.

FIG. 7 is a flowchart illustrating a method of driving the OLED display apparatus according to an embodiment of the present invention. FIG. 8 is an example diagram illustrating a state where a data voltage is output to each horizontal line of the OLED display apparatus according to an embodiment of the present invention. FIG. 9 is a graph showing a luminance of a horizontal line where sensing is performed and a luminance of a horizontal line where sensing is not performed, in the OLED display apparatus according to an embodiment of the present invention. FIG. 10 is a graph for describing a level of a compensation value applied to the OLED display apparatus according to an embodiment of the present invention. FIG. 11 is another graph for describing a level of a compensation value applied to the OLED display apparatus according to an embodiment of the present invention.

FIG. 8 shows a state where an image is displayed on each horizontal line. In FIG. 9, point A refers to one sub-pixel provided on a horizontal line where sensing for external compensation is not performed, and point B refers to one sub-pixel provided on a horizontal line where the sensing for external compensation is performed. Plot (a) of FIG. 9 shows luminance at the point A, and plot (b) of FIG. 9 shows luminance at the point B.

With reference to FIG. 7, in operation 5602, the compensation value may be stored in the memory 450. The compensation value may be calculated based on various pieces of information which are calculated when the sensing for external compensation is actually performed in a process of manufacturing the panel 100, or may be calculated through various simulations, and may be stored in the memory 450.

The compensation value may be applied as the same value for all the sub-pixels 110 provided in the panel 100, may be changed based on a gray scale of the input image data, may be changed based on a position of each horizontal line in the panel 100, may be changed based on a color corresponding to the input image data, or may be changed based on one or more of the gray scale of the input image data, the position of each horizontal line, and the color.

For example, the compensation value may be applied as the same value for all the sub-pixels 110 provided in the panel 100. That is, the compensation value may be applied as the same value for all colors and all the sub-pixels 110.

As another example, the compensation value may be changed based on the color of input image data. FIG. 10 shows a plurality of the compensation values for red (R), white (W), green (G), and blue (B), and the plurality of compensation values may differ by color. For example, a compensation value for R input image data corresponding to an R sub-pixel may be 0.01 V, a compensation value for W input image data corresponding to a W sub-pixel may be 0.013 V, a compensation value for G input image data corresponding to a G sub-pixel may be 0.011 V, and a compensation value for B input image data corresponding to a B sub-pixel may be 0.009 V.

As another example, the compensation value may be changed based on the gray scale of the input image data. For example, as shown in FIG. 10, the compensation value for the input image data may be variously changed based on a gray scale.

As another example, the compensation value may be changed based on a position of a horizontal line of a sub-pixel to which the input image data is to be output. For example, in plot (a) of FIG. 10, L refers to a grayscale-based compensation value of R input image data which is output to a sub-pixel provided on a horizontal line provided at an upper portion X of the panel 100, M refers to a grayscale-based compensation value of R input image data which is output to a sub-pixel provided on a horizontal line provided at a middle portion Y of the panel 100, and N refers to a grayscale-based compensation value of R input image data which is output to a sub-pixel provided on a horizontal line provided at a lower portion Z of the panel 100.

As another example, the compensation value may be calculated based on at least one (e.g., one or more) of the gray scale of the input image data, the position of the horizontal line, and the color. That is, as described above, because the compensation value is variously changed based on at least one of the gray scale of the input image data, the position of the horizontal line, and the color, the compensation value may be calculated based on all of the above-described information.

FIG. 11 shows a current applied to an organic light emitting diode in a sub-pixel where sensing is not performed, and a current applied to an organic light emitting diode in a sub-pixel where the sensing is performed. With reference to FIG. 11, when sensing is performed, a current applied to an organic light emitting diode is low, and in this case, when the sub-pixels are driven with the same data voltage Vdata, luminance is lowered. Therefore, according to embodiments as described above, the compensation value may be added to the input image data so as to increase luminance by supplementing a current. The compensation value added to the input image data may be a value associated with a gray scale. However, the compensation data voltage substantially increases due to the compensation value. Hereinabove, for convenience of description, the compensation value has been described as a voltage.

Subsequently, in the sensing mode, data voltages may be sequentially supplied to a plurality of sub-pixels configuring one unit pixel 120, and thus, a characteristic change of each of a plurality of driving transistors respectively included in the plurality of sub-pixels may be sensed. That is, external compensation may be performed for each horizontal line in operation S604.

In this case, as shown in FIG. 5, one sensing line may be provided in the unit pixel 120. That is, while the reference voltage is being applied to the one sensing line, a data voltage may be supplied to only a data line provided in one of the plurality of sub-pixels configuring the unit pixel 120, and thus, a characteristic change of a driving transistor included in a sub-pixel to which the data voltage is supplied may be sensed.

The above-described operation may be performed four times, and thus, sensing data for four sub-pixels configuring one unit pixel may be generated. Therefore, sensing data for all sub-pixels provided on one horizontal line may be generated.

The calculator 410 may calculate the external compensation value based on the sensing data. A detailed method of calculating the external compensation value, as described above, may use methods disclosed in related art as noted above.

The sensing mode, as shown by example in FIG. 8, may be executed for the blank time between frames. Data voltages may not be output to the data lines for the blank time. However, because data voltages charged into a plurality of sub-pixels provided on each horizontal line HL are continuously held, as shown in FIG. 8, an image may be displayed by the panel 100 for the blank time.

However, during the blank time, a sensing data voltage for sensing may be supplied to each of a plurality of sub-pixels provided on a horizontal line (for example, an nth horizontal line nHL in FIG. 8) where the sensing is performed, and thus, an image may not be displayed on a plurality of sub-pixels provided on the nth horizontal line nHL for the blank time.

A period from a time when the compensation data voltage is output to the data line before sensing is performed, to a time when an image is displayed with the compensation data voltage after the sensing is performed, may correspond to one frame period.

A period from a time when an image is displayed by outputting a normal data voltage to a horizontal line where sensing is not performed, to a time when an image is displayed by outputting another normal data voltage to the horizontal line, may be referred to as one frame period. In this case, a period from a time when the compensation data voltage is output before the sensing is performed, to a time when an image is displayed with the compensation data voltage after the sensing is performed, may correspond to one frame period. When the one frame period elapses, the normal data voltage or the external compensation data voltage may be supplied to a plurality of sub-pixels provided on a horizontal line where the sensing has been performed.

Subsequently, when input image data corresponding to a horizontal line where the sensing is performed is received in the display mode, the data aligner 430 may convert the input image data into compensation image data, based on the compensation value stored in the memory 450. The data driver 300, particularly, the data voltage supply unit 310, may convert the compensation image data into the compensation data voltage and output the compensation data voltage to the data line.

For example, as shown in FIG. 8, when the sensing is performed for the nth horizontal line nHL for the blank time (e.g., in the sensing mode), a period before and after the blank time may be included in the display mode.

Therefore, in a frame immediately before the blank time, the data aligner 430 may generate the compensation image data corresponding to the sub-pixels provided on the nth horizontal line nHL and may transfer the compensation image data to the data voltage supply unit 310, and the data voltage supply unit 310 may convert the compensation image data into the compensation data voltage and output the compensation data voltage to the data line.

Moreover, when the blank time terminates, the data aligner 430 may immediately generate the compensation image data corresponding to the sub-pixels provided on the nth horizontal line nHL and may transfer the compensation image data to the data voltage supply unit 310, and the data voltage supply unit 310 may convert the compensation image data into the compensation data voltage and output the compensation data voltage to the data line.

Luminance CD corresponding to the compensation image data, as shown in FIGS. 8 and 9 plot (b), may be higher than luminance RD corresponding to the input image data.

For example, although a data voltage corresponding to the input image data is not output to the sub-pixels provided on the nth horizontal line nHL for the blank time, a data voltage based on the input image data which enables an output of luminance higher than luminance corresponding to the data voltage based on the input image data may be output to the sub-pixels provided on the nth horizontal line nHL before and after the blank time. Therefore, an average value of luminance of the nth horizontal line nHL to which data voltages corresponding to the compensation image data are output may be a value similar to a luminance of a horizontal line to which data voltages corresponding to the input image data are output.

Therefore, as shown in FIG. 9, a luminance difference may not occur between a sub-pixel A provided on a horizontal line where the sensing is not performed, and a sub-pixel B provided on a horizontal line where the sensing is performed. Therefore, the horizontal line where the sensing is performed may be prevented from being observed as darker than the horizontal line where the sensing is not performed.

In the display mode, the input image data is received which corresponds to the horizontal line where the sensing is not performed, and when external compensation for the input image data is needed, the data aligner 430 may convert the input image data into the external compensation image data, based on the external compensation value. Therefore, the external compensation data voltage may be output.

On the other hand, in the display mode, when the external compensation for the input image data is not needed, the data aligner 430 may realign the input image data so as to match the structure of the panel 100, thereby converting the input image data into the normal image data. That is, the input image data where external compensation is not needed may be converted into the normal image data, and the data voltage supply unit 310 may convert the normal image data into the normal data voltage and output the normal data voltage to the data line.

The external compensation data voltage, the compensation data voltage, and the normal data voltage may be output to the data line in the display mode. For example, the compensation data voltage may be output to a plurality of sub-pixels provided on a horizontal line where the sensing is performed, and the external compensation data voltage and the normal data voltage may be output to a plurality of sub-pixels provided on a horizontal line where the sensing is not performed.

According to example embodiments of the present invention, an observable level where a horizontal line is sensed for real-time external compensation may be reduced, enhancing the user's viewing experience.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A display apparatus comprising:

a panel including a plurality of sub-pixels, a plurality of data lines, and a plurality of horizontal lines;

a sensing circuit configured to collect sensing data by sensing for external compensation in each of the horizontal lines;

a calculator configured to determine a characteristic change of each of the sub-pixels using the sensing data to calculate an external compensation value;

a data aligner configured to receive input image data, and when the input image data corresponds to a horizontal line where the sensing is performed, to convert the input image data into compensation image data based on a compensation value; and a data driver configured to output a compensation data voltage corresponding to the compensation image data to a data line corresponding to the sensed horizontal line before and after the sensing is performed, and output a sensing data voltage to the data line while the sensing is performed.

2. The display apparatus of claim 1, wherein the plurality of data lines are provided in a first direction of the panel, a plurality of sensing lines are arranged in parallel with the plurality of data lines, and each of the plurality of sensing lines is connected to at least three sub-pixels configuring each of a plurality of unit pixels that are provided on one horizontal line.

3. The display apparatus of claim 1, wherein the sensing circuit performs the sensing for a blank time which is provided between frames and during which an image signal is not output.

4. The display apparatus of claim 1, wherein when the data aligner receives the input image data that corresponds to the sensed horizontal line, the data aligner converts the input image data into the compensation image data by adding the compensation value to the input image data.

5. The display apparatus of claim 4, wherein luminance corresponding to the compensation image data is higher than luminance corresponding to the input image data.

6. The display apparatus of claim 1, wherein the display apparatus is configured such that:

the compensation value is applied as a same value for all the plurality of sub-pixels in the panel, the compensation value is changed based on at least one of:

a gray scale of the input image data, a position of each horizontal line in the panel, a color corresponding to the input image data.

7. The display apparatus of claim 6, wherein the display apparatus is configured such that the compensation value is changed based on all of the gray scale of the input image data, the position of each horizontal line, and the color.

8. The display apparatus of claim 1, wherein one frame period is defined as from a time when the compensation data voltage is output to a data line before the sensing is performed, to a time when an image is displayed with the compensation data voltage after the sensing is performed on a horizontal line corresponding to the data line.

9. The display apparatus of claim 1, wherein when the data aligner receives input image data corresponding to a horizontal line where the sensing is not performed, the data aligner performs the external compensation on the input image data using the external compensation value to convert the input image data into external compensation image data, or does not perform the external compensation but realigns the input image data to convert the input image data into normal image data, according to a calculator control signal transferred from the calculator, and the data driver outputs the external compensation image data or the normal image data to the data line in the panel at every one horizontal period.

* * * * *